United States Patent [19]

Evans

[11] Patent Number: 4,513,705

[45] Date of Patent: Apr. 30, 1985

[54] PRESSURIZED LUBRICATION ASSEMBLY FOR THE CENTER BEARING OF A TURBOCHARGER

[76] Inventor: John W. Evans, Rte. 41, Sharon, Conn. 06069

[21] Appl. No.: 557,321

[22] Filed: Dec. 2, 1983

[51] Int. Cl.[3] ..... F02B 33/40

[52] U.S. Cl. ..... 123/196 S; 123/196 R; 60/605; 184/6.3

[58] Field of Search ..... 123/196 A, 196 R, 196 S, 123/196 M; 184/6.3, 6.4; 60/605

[56] References Cited

U.S. PATENT DOCUMENTS

| | | | |
|---|---|---|---|
| 2,736,307 | 2/1956 | Wilcox | 123/196 S |
| 2,755,787 | 7/1956 | Butler et al. | 123/196 S |
| 2,889,821 | 6/1959 | Maki | 123/196 S |
| 3,045,420 | 11/1962 | Addie et al. | 60/605 |
| 3,057,432 | 10/1962 | Jacobson et al. | 123/196 A |
| 3,425,404 | 2/1969 | Lamkin | 123/196 S |
| 3,722,623 | 3/1973 | Waldecker | 123/196 S |
| 4,094,293 | 6/1978 | Evans | 123/196 M |
| 4,126,997 | 11/1978 | Henson | 60/605 |
| 4,331,112 | 5/1982 | Pluequet | 60/605 |
| 4,359,140 | 11/1982 | Shreve | 123/196 S |

*Primary Examiner*—E. Rollins Cross
*Attorney, Agent, or Firm*—Kenyon & Kenyon

[57] ABSTRACT

A lubrication assembly for supplying pressurized lubricant to the center bearing of an exhaust-driven turbocharger associated with an internal combustion engine during turbocharger spin down after the engine has been shut down comprises a reservoir means for storing a quantity of lubricant under pressure. The reservoir means is coupled in fluid communication with the lubricant line which supplies lubricant to the center bearing when the engine is running. A valve means controls flow of lubricant between the center bearing lubricant line and the reservoir means. This valve means permits the reservoir means to capture and store lubricant at peak engine lubricant pressure. The valve means releases lubricant from the reservoir means to the center bearing in order to provide lubricant to the center bearing during the turbocharger spin down period after engine shut down when the engine lubricant pump is likewise shut down. The preferred valve means is a diaphragm type bi-directional valve which is solenoid actuated.

15 Claims, 3 Drawing Figures

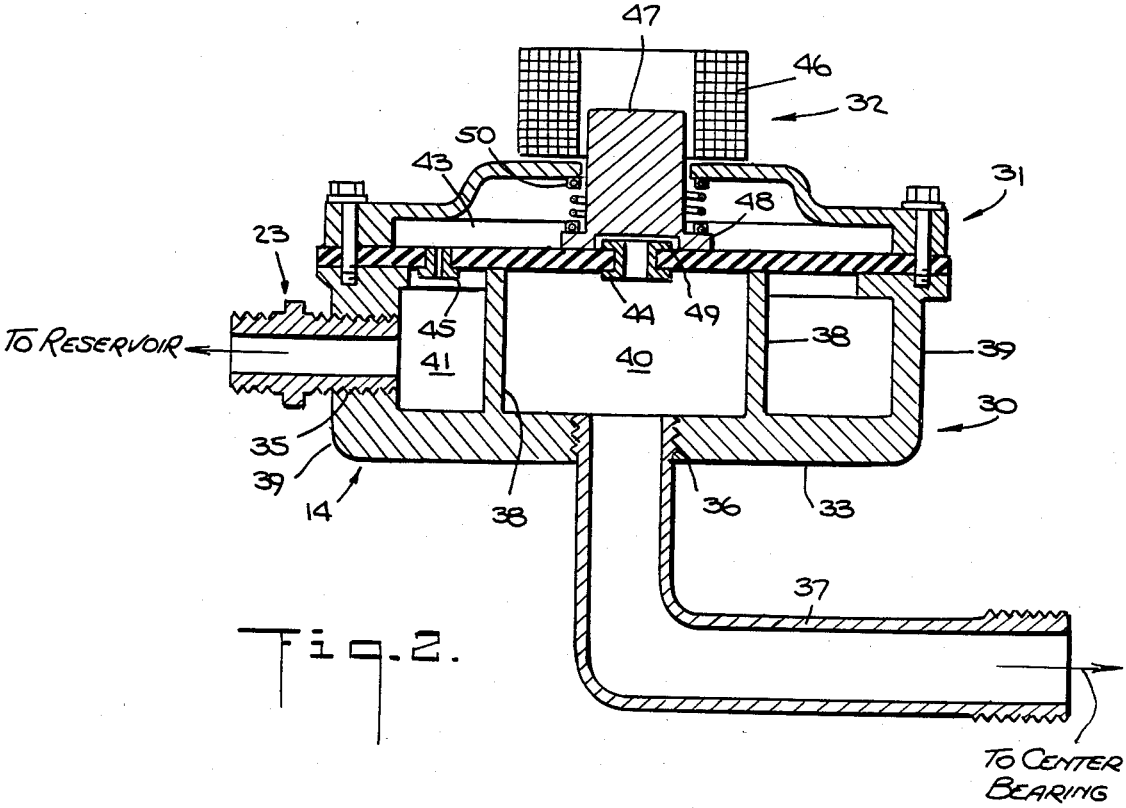
Fig. 2.
Fig. 3.
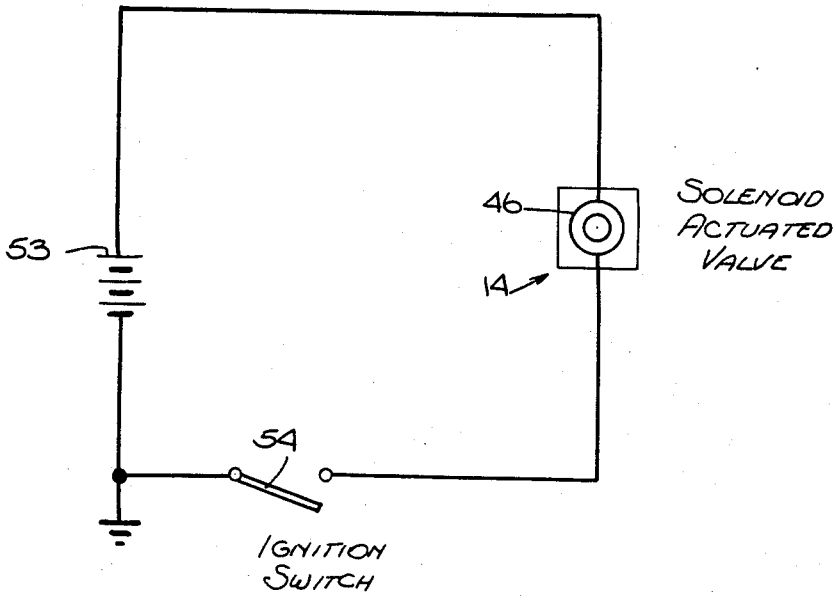

PRESSURIZED LUBRICATION ASSEMBLY FOR THE CENTER BEARING OF A TURBOCHARGER

FIELD OF THE INVENTION

This invention relates to a pressurized lubrication assembly for the lubrication of the center bearing of an exhaust-driven turbocharger.

BACKGROUND OF THE INVENTION

Exhaust-driven turbochargers are themselves well known in the automotive arts. The idle speed of an exhaust-driven turbocharger often exceeds 30,000 rpm with top speeds of 90,000 to 120,000 rpm. When the automobile engine is operating, lubrication is supplied to the turbocharger's center bearing by the engine's lubrication system. When the engine shuts down, the flow of oil to the turbocharger center bearing essentially ceases. A time period of about 20 to 30 seconds can elapse between the time that the engine shuts down and the time at which the turbocharger stops turning. During this time period, the center bearing temperature can increase to as high as 1200° F. At such high temperatures, and because of the lack of oil flow, the small amount of oil remaining in the turbocharger center bearing carbonizes and ultimately the bearing will fail as a result of galling or seizure.

The use of prelubricating devices and oil reservoirs or accumulators of various designs in conjunction with internal combustion engines are generally well known. These systems are used to prevent engine wear during starting of an internal combustion engine after it has been shut down for a sufficient time to allow its lubricating oil to drain into the engine's oil pan and crank case. This leaves many vital engine parts with no lubricant protection until the engine has been started and the oil pressure brought up to an acceptable level by the oil pump. Various preoiling devices have been designed, all having the purpose of providing oil pressure to the engine prior to start up.

My prior U.S. Pat. No. 4,094,293 issued June 13, 1978 discloses an engine preoiler and lubricant reservoir assembly comprising a hollow cylinder divided into two chambers by a slidable piston. U.S. Pat. No. 4,094,293 also discloses a highly advantageous solenoid controlled valve assembly which regulates the flow of lubricating fluid out of the oil reservoir when the engine is started up or in instances when oil pressure is low and conversely, into the reservoir during periods of normal engine operation.

My copending U.S. patent application Ser. No. 557,397 filed Dec. 2, 1983, which is a continuation-in-part of Application Ser. No. 331,371 filed Dec. 16, 1981 entitled "Improved Engine Prelubricator and Pressurized Lubricant Reservoir", discloses an improved preoiler device having a hollow cylindrical reservoir container, i.e., a reservoir without a piston or a diaphragm. Use of the same solenoid controlled valve assembly disclosed in my U.S. Pat. No. 4,094,293 may be used in conjunction with prelubrication of an internal combustion engine using this hollow reservoir container.

My foregoing copending U.S. patent application Ser. No. 557,397 also discloses that the improved hollow reservoir, i.e., a reservoir without a piston or diaphragm, may be used to supply lubricating fluid to the center bearing of an exhaust-driven turbocharger. No type of valve assembly is used to positively control flow of lubricant from the engine lubricating system to the reservoir or from the reservoir to the center bearing. When the engine is operating normally, the pressurized oil from the engine lubrication system supplies oil both to the center bearing and for charging the reservoir through a T-connection. When the engine shuts down, the reservoir supplies oil for lubricating the center bearing during spin down. A check valve in the T-connection prevents oil from the reservoir from flowing directly to the engine.

The foregoing described center bearing lubrication system works satisfactorily. However, there are disadvantages. Upon the engine start-up, during the time period when the engine is initially building up engine oil pressure, oil flow should go to the engine and the center bearing. However, some of the oil in the foregoing system will go to charging the reservoir which is not desirable during the early start-up period. Once initial start-up has been completed, oil pressure is at a maximum when the engine is warming up and viscosity of the oil is high. However, the foregoing system is unable to retain this maximum pressure in the reservoir because as the engine attains normal operating pressure, the pressure of oil stored in the reservoir will equalize with the normal engine oil pressure.

OBJECT OF THE INVENTION

It is therefore an object of the present invention to provide an improved pressurized lubrication assembly for the lubrication of the center bearing of an exhaust-driven turbocharger during the time period immediately after engine shut down.

It is a further object of the present invention to provide a pressurized lubrication assembly for the lubrication of the center bearing of an exhaust-driven turbocharger having automatically actuated control valve means for regulating unrestricted flow of lubricant from the engine oil system to the reservoir for charging the reservoir and regulating unrestricted flow of lubricant from the reservoir to the turbocharger for lubricating the turbocharger center bearing after engine shut down.

It is yet another object of the present invention to provide a pressurized lubrication assembly for the lubrication of the center bearing of an exhaust driven turbocharger wherein maximum or peak engine lubricant pressure may be stored in the lubrication system reservoir for use in the lubrication of the turbocharger center bearing after engine shut down.

These and other objects of the present invention will become apparent from the following description and claims in conjunction with the drawings.

SUMMARY OF THE INVENTION

The center bearing of an exhaust-driven turbocharger associated with an internal combustion engine is lubricated by the lubrication system of the internal combustion engine when the engine is running. A flow of pressurized lubricant is provided to the turbocharger by the engine lubrication system via a first conduit means.

In accordance with the invention, a reservoir means is provided for storing a quantity of lubricant under pressure. A second conduit means couples the reservoir means to the first conduit means. Valve means are disposed in the second conduit means for controlling the flow of lubricant between the first conduit means and the reservoir means. The valve means substantially restricts flow of lubricant from the first conduit means to the reservoir means when the pressure of the lubricant flowing in the first conduit means is below a selected pressure. The valve means permits substantially unrestricted lubricant flow from the first conduit means to the reservoir means when the pressure of the lubricant flowing in the first conduit means is at or exceeds the selected pressure. The valve means also substantially prevents flow of lubricant from the reservoir means to the first conduit means when the engine is providing a flow of pressurized lubricant to the turbocharger. The valve means also provides for substantially unrestricted flow of lubricant stored in the reservoir to the first conduit means and thereby to the turbocharger when the engine is not providing said flow of pressurized lubricant to the turbocharger.

Substantially unrestricted flow of lubricant from the first conduit means to the reservoir means when the pressure of lubricant flowing in the first conduit means exceeds the selected pressure results in filling the reservoir means with lubricant wherein the lubricant received by the reservoir means compresses air contained within the reservoir means thereby providing a quantity of lubricant stored under pressure in the reservoir means. This stored lubricant is available to provide lubrication for the turbocharger center bearing when the engine is shut-off and accordingly flow of lubricant in the first conduit means from the engine lubrication system ceases. Thus, lubrication is supplied to the turbocharger during the time period between engine shut down and the time the turbocharger stops turning.

In accordance with one salient feature of the present invention, the valve means operates to store maximum or peak engine lubricant pressure in the reservoir means for subsequent use for providing pressurized lubricant to the center bearing of the turbocharger after engine shut down.

The valve means, in accordance with the present invention, is preferably a solenoid actuated valve means. However, other types of control valve means may be used.

In preferred embodiments of the present invention, the solenoid actuated valve means is energized when the engine is providing a flow of pressurized lubricant to the turbocharger. The energized solenoid actuated valve means substantially prevents flow of lubricant from the reservoir means to the first conduit. The solenoid actuated valve means is de-energized when the engine is not providing a flow of pressurized lubricant to the turbocharger. The de-energized solenoid actuated valve means permits substantially unrestricted lubricant flow from the reservoir means to the first conduit means and thereby to the turbocharger for lubricating the center bearing of the turbocharger after engine shut down.

In advantageous embodiments of the present invention, the solenoid actuated valve means would be energized when the engine is running and de-energized when the engine is shut off.

An advantageous valve means for use in accordance with the present invention is a diaphragm type valve having a solenoid actuated plunger. The plunger selectively cooperates with the diaphragm for selectively permitting and preventing fluid flow between chambers of the valve and thereby selectively controlling the flow of lubricant through the valve means.

Although preferred valve means are described herein, those skilled in the art will be able to provide other types of valve means in order to practice the invention. For example, instead of using solenoid actuated valve means, one may select the use of vacuum operated valve means.

BRIEF DESCRIPTION OF THE DRAWINGS

In the drawings forming part hereof:

FIG. 2 is a cross-sectional side view of one embodiment of a solenoid actuated valve means for use with the lubrication assembly illustrated in FIG. 1 all in accordance with the present invention; and FIG. 3 is a schematic diagram of one embodiment of a valve actuating means for use in conjunction with the valve means illustrated in FIG. 2 in accordance with the present invention.

In the figures of the drawings, like numerals indicate like parts.

DESCRIPTION OF THE PREFERRED EMBODIMENTS

Figure 1:
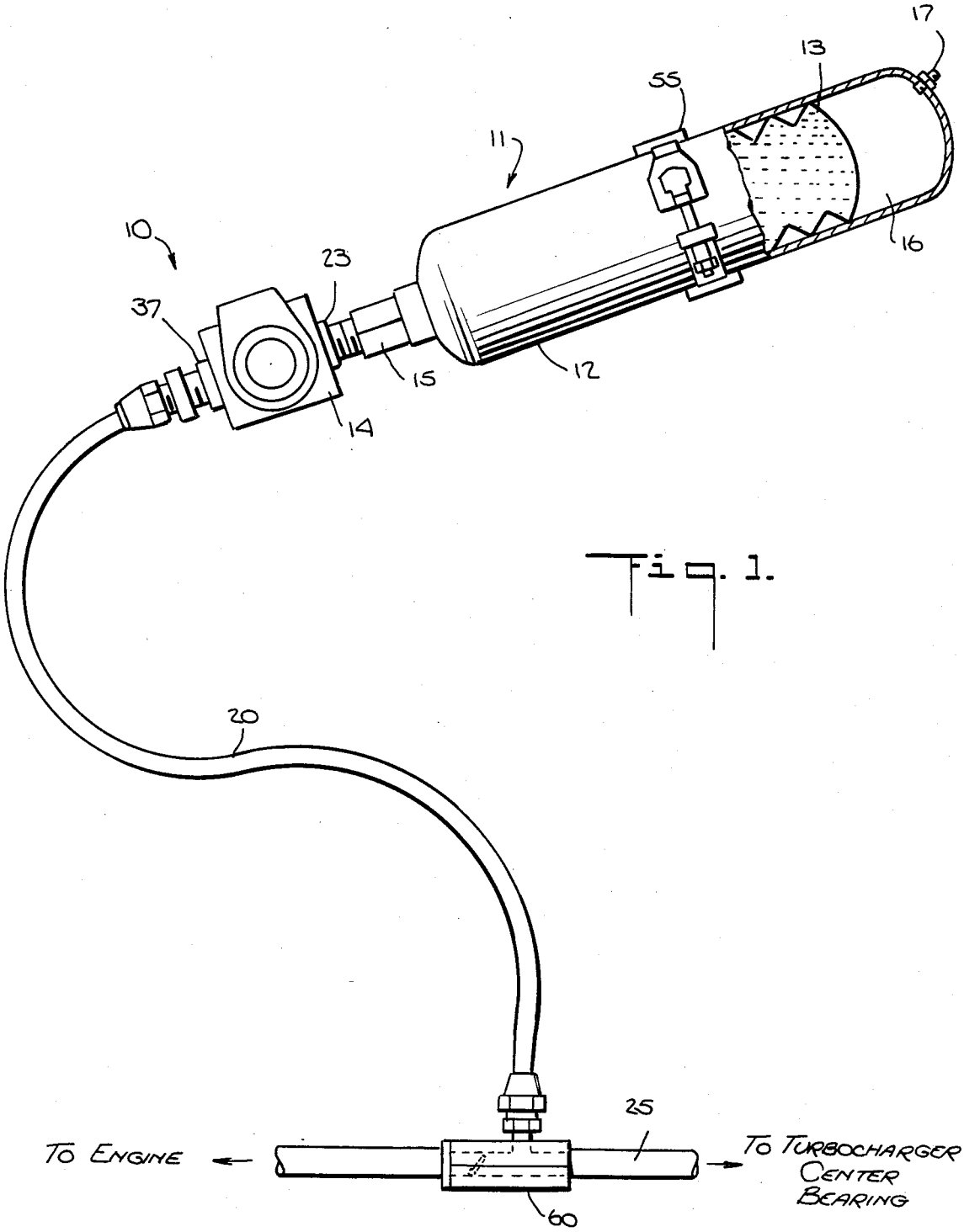
FIG. 1 schematically illustrates a pressurized lubrication assembly with parts broken away for lubricating the center bearing of an exhaust-driven turbocharger after engine shut down in accordance with one embodiment of the present invention.

In order to afford a more complete understanding of the present invention and an appreciation of its advantages, a description of the preferred embodiments is presented in the following.

FIG. 1 schematically illustrates a pressurized lubricant assembly 10 for lubricating the center bearing of an exhaust-driven turbocharger associated with an internal combustion engine in accordance with the present invention. The assembly broadly comprises a reservoir means 11 which is coupled in fluid communication by fluid conduit means 20 to a fluid conduit means 25. Conduit means 25 is an oil line which extends from the oil system of an internal combustion engine [not illustrated] to the center bearing of the exhaust-driven turbocharger [not illustrated]. In accordance with the prior art practice, fluid conduit means 25 will supply the center bearing with pressurized lubricant or oil when the engine [and thus the engine oil pump] is running.

In the illustrated embodiment of the present invention, fluid conduit means 20 is connected to fluid conduit means 25 by a check valve 60. Check valve 60 permits flow of lubricant in fluid conduit means 25 from the engine lubricant system to both fluid conduit means 20 and the turbocharger center bearing. Check valve 60 also permits flow of lubricant from fluid conduit means 20 into fluid conduit means 25 and then to the center bearing. Check valve 60 does not permit the flow of lubricant from fluid conduit means 20 into conduit means 25 to directly flow toward the engine lubricant system.

It will be appreciated that fluid conduit means 20 has coupled reservoir means 11 and fluid conduit means 25 in fluid communication. A valve means 14 is disposed in fluid conduit means 20 for controlling the flow of lubricant between reservoir means 11 and fluid conduit means 25. The reservoir means 11 stores a quantity of lubricant under pressure as will hereinafter be discussed.

The valve means 14 prevents flow of lubricant from fluid conduit means 25 into reservoir means 11 when the pressure of the lubricant flowing from the engine oil pump in fluid conduit means 25 is below a selected pressure, e.g., 40 psig. The valve means 14 permits [but does not require] substantially unrestricted flow of lubricant from fluid conduit means 25 into reservoir means 11 when the pressure of the lubricant flowing in fluid conduit means 25 as a result of the engine oil pump is at or above a selected pressure, e.g., 40 psig.

The valve means 14 prevents flow of lubricant stored under pressure in reservoir means 11 to fluid conduit means 25 and thereby to the center bearing of the turbocharger when the engine oil pump is providing a flow of pressurized lubricant via fluid conduit means 25 to the center bearing. The valve means 14 provides a substantially unrestricted flow of lubricant from the reservoir means 11 to fluid conduit means 25 and thereby to the center bearing of the turbocharger when the engine oil pump is not providing a flow of pressurized lubricant to the center bearing, e.g., when the engine is shut-off. The check valve 60 prevents flow of lubricant from the reservoir means 11 directly to the engine lubricant system. That is, check valve 60 directs the flow of lubricant from the reservoir means 11 to the center bearing of the turbocharger.

Reservoir means 11 is a pressurized lubricant reservoir of the type used in machinery preoiling assemblies such as described in my U.S. Pat. No. 4,094,293. The reservoir means 11 comprises a generally cylindrical shaped container 12 which may be mounted to a motor vehicle engine compartment or remotely on a frame member by, e.g., strap 55. When lubricant flows into reservoir means 11, air that is stored within container 12 of reservoir means 11 is compressed by the lubricant. .

The reservoir means illustrated in FIG. 1 is substantially similar to the bellows-type reservoir disclosed and claimed in my co-pending U.S. patent application Ser. No. 557,470 filed Dec. 2, 1983 entitled "Improved Machinery Prelubricator Device Having a Bellows Type Reservoir Assembly" the disclosure of which is expressly incorporated herein by reference. An expandable and contractable bellows means 13 is disposed in container 12. The bellows means 13 has one end sealingly joined to fluid passage or bushing 15 which penetrates an end of the reservoir container 12. Fluid passage 15 is connected with valve means 14. When valve 14 permits flow of pressurized lubricant from fluid conduit means 25 into reservoir means 11, the bellows means 13 receives the lubricant and expands under the influence of the received lubricant within the container 12. Expansion of the bellows means 13 causes compression of the air stored in container 12 on the air side 16 of the bellows. Accordingly, a quantity of lubricant is stored under pressure in bellows means 13. When valve means 14 provides for substantially unrestricted lubricant flow from reservoir means 11 to fluid conduit means 25 and thereby to the center bearing, the compressed air within air side 16 of container 12 compresses the bellows means 13 forcing lubricant through valve means 14, fluid conduit means 20, fluid conduit means 25 and thus to the center bearing of the turbocharger, For details concerning the reservoir means 11 comprising an expandable bellows means reference should be made to the hereinbefore referred to patent application.

It should be understood that the present invention is not limited to any specific form of reservoir means. The pressurized lubricant piston type reservoir disclosed in my U.S. Pat. No. 4,094,293 and the hollow container type reservoir disclosed in my copending U.S. patent application Ser. No. 557,397 which is a continuation-in-part of my U.S. patent application Ser. No. 331,371 filed Dec. 16, 1981 would work very satisfactorily.

A salient feature of the present invention is that the peak lubrication pressure provided by the engine lubrication pump in fluid conduit means 25 is stored in the reservoir means 11 for use in supplying lubricant to the center bearing of the turbocharger after the engine is shut down. The functioning of the assembly of the present invention may be described as follows.

A cold engine is started. There would be little or substantially no lubricant stored in the reservoir means 11 at this time. The engine oil pump slowly begins to build up lubricant pressure. At engine start up, it would be undesirable for lubricant to flow into the reservoir means 11 because the lubricant is needed to lubricate the engine and the center bearing of the turbocharger. During the low pressure period at engine start up, the valve means 14 would restrict lubricant from flowing into the reservoir means 11. Advantageously, the lubricant would be substantially prevented from flowing into the reservoir means at this time.

Assume that the turbocharger lubrication system is designed to normally operate at about 40 psig. When the pressure of the lubricant flowing in fluid conduit means 25 builds up to 40 psig, valve means 14 will operate and permit substantially unrestricted lubricant flow from fluid conduit means 25 via fluid conduit means 20 into reservoir means 11 for storage. The lubricant flowing into reservoir means 11 will compress the air contained in container 12 of reservoir means 11 and thus the stored lubricant will be stored under pressure. Fluid conduit means 25 will continue to supply the center bearing of the turbocharger with pressurized lubricant.

During the time period immediately after start up, the viscosity of the lubricant is highest and thus the lubricant system will reach a peak pressure sometime soon after start up. For a turbocharger lubricant system that normally operates at about 40 psig., a peak pressure of, for example, 65 to 70 psig. will be reached when the engine and lubricant system is still relatively cold because of the high lubricant viscosity or during high rpm periods in lower gear ratios. This peak pressure will be stored in the reservoir means 11.

As the engine warms up, the pressure of the lubricant will decrease toward its examplary design value of about 40 psig at running speed and 20 psig at idle as the lubricant viscosity decreases. However, the valve means 14 substantially prevents flow of lubricant from the reservoir means 11 to fluid conduit means 25 and thereby the center bearing of the turbocharger when the engine is providing a flow of pressurized lubricant to the center bearing. Therefore, in accordance with the present invention, the peak pressure which occurs soon after engine start-up and during high rpm is stored in the reservoir means 11 for subsequent use.

When the engine is shut down, the engine lubrication pump will stop providing a flow of pressurized lubricant to the center bearing of the turbocharger. When this occurs, valve means 14, which is triggered by ignition open circuit, operates to provide a substantially unrestricted flow of lubricant from the reservoir means 11 through valve means 14, through fluid conduit means 20, through fluid conduit means 25 and thence to the center bearing of the turbocharger. Thus the center bearing is provided with a pressurized lubricant flow during its spin down period after engine shut down. Peak lubricant pressure has been stored in the reservoir means 11 for this purpose.

By way of example, reservoir means 11 may be sized and dimensioned to hold about 1 to 1½ quarts of oil at 60 psig. Reservoir means 11 may, if desired, be provided with air valve 17 whereby compressed air may be introduced into the air space 16 of the container 12. This may be used to adjust the lubricant storage capacity of the reservoir means at peak pressure. It will be appreciated that increase or decrease of the static air pressure charge in a given reservoir container 12 will increase or decrease respectively the lubricant capacity of the reservoir for a given lubricant working pressure. Air valve 17 may also be used for the introduction of pressurized air into the reservoir means 11 during lubricant changes in order to purge the reservoir.

By way of example, if a turbocharger center bearing lubrication system has a normal hot operating design pressure of about 40 psig (Hot 180° F.), the turbocharger lubrication oil system is run at steady state hot operation at about 40 psig. and will typically idle (hot) at, e.g., about 15 to 20 psig. The cold peak pressure, when lubricant viscosity is greatest, and the high rpm pressure will typically be, e.g., about 65 to 70 psig. Cold idling would typically be, e.g., at about 30 to 35 psig. It is understood that the foregoing pressures are given only by way of example.

The assembly of the present invention illustrated in FIG. 1 may also be designed to provide adequate lubrication at the center bearing of the turbocharger during the very initial period of engine start-up. Normally, the shaft in the center bearing of the turbocharger acts as a pump during the turbocharger spin down period after the engine is shut down. As a result, all the lubricant is drained from the lubricant line 20, 25 feeding the center bearing. During engine start-up, the lubricant line is thus empty and a lag is created during the time between the generation of lubricant pressure by the engine and the time when pressurized lubricant reaches the center bearing. By dimensioning the reservoir so that its capacity is greater than the volume of lubricant drained out of the lubricant line by the turbocharger spin-down, the lubricant line will remain full after the turbocharger has stopped spinning and instant oil pressure will be supplied to the center bearing at its subsequent start-up due to the lubricant stored in the lubricant line and the pumping action of the shaft of the center bearing.

A preferred valve means 14 and a preferred valve actuating means for use with the assembly, in accordance with the present invention, will now be described in conjunction with FIGS. 2 and 3.

With reference to FIG. 2, valve assembly 14 is comprised generally of a valve body portion 30, a valve cover portion 31 and a solenoid actuator 32. Valve body 30 includes a bottom portion 33 and upstanding walls 39, one of which is provided with a threaded aperture 35 into which connector 23 is screwed. In the embodiment illustrated in FIG. 1, connector 23 is screwed into bushing 15 of reservoir means 11 so that the valve body is in fluid communication with reservoir bellows 13. The bottom 33 of valve body 30 is provided with a threaded aperture 36 into which a suitable connector 37 is screwed which is in turn connected to fluid conduit means 20 as illustrated in FIG. 1. At least one interior partition 38 extends upwardly within the valve body to the same height as walls 30 of the valve body and divides the valve body into two chambers. A first or inner chamber 40 is in communication with the fluid conduit means 20 via connector 37 through aperture 36, and a second or outer surrounding annular chamber 41 is in fluid communication with reservoir means 11 through connection 23. There are preferably four partitions 38 which form a rectangular chamber around threaded aperture 36. However, it is only necessary that the valve body be divided into two chambers with aperture 35 in one and aperture 36 in the other.

As may be seen in FIG. 2, a resilient diaphragm 42 is positioned between valve body 30 and cover 31. This diaphragm 42 is generally planar in its unflexed state and abuts the upper ends of interior partition 38, thus further defining first or inner chamber 40 and second or outer chamber 41 in valve body 30 and defining a third chamber 43 above diaphragm 42 and below cover 31. A first aperture 44 passes through diaphragm 42 and below cover 31. The first aperture 44 passes through diaphragm 42 at a portion of the diaphragm 42 within the perimeter of first chamber 40. A second aperture 45 passes through the diaphragm 42 at a position within the perimeter of second chamber 41. First aperture 44 is larger than second aperture 45 and may be, by way of example, twice as large.

Solenoid assembly 32 is mounted on valve cover 31 and includes a conventional field coil 46 and a conventional iron core or plunger 47 which passes through a suitable opening in the cover 31. The lower portion of plunger 47 terminates in an outwardly extending, circumferential lip 48 and an inner recess 49 which surrounds central aperture 44 in diaphragm 42 when the plunger is in its energized position.

When the solenoid 32 is energized, plunger member 47 is forced by the action of the solenoid 32 against diaphragm 42 and the circumferential lip 48 of plunger member 47 surrounds central aperture 44. When the solenoid 32 is deenergized, plunger member 47 is forced upward out of contact with diaphragm member 42 by the action of spring member 50 thus permitting fluid communication with chamber 43 through aperture 44.

It will be appreciated that when solenoid 32 is energized and plunger 47 is urged against diaphragm 42 by the action of solenoid 32, spring member 50 is stretched in tension. This tension force of spring member 50 urges plunger 47 to move upward out of contact with diaphragm 42 when solenoid 32 is de-energized.

The valve means 14 illustrated in FIG. 2 is substantially similar to the value assembly disclosed in my U.S. Pat. No. 4,094,293. The principal differences of the valve means 14 illustrated in FIG. 2 is that the solenoid 32 of FIG. 2 causes the plunger 47 to be forced against diaphragm 42 when the solenoid is energized. In contrast, in the valve assembly described and disclosed in my U.S. Pat. No. 4,094,293, the energized solenoid causes the plunger 47 to be lifted off the diaphragm.

This difference in the valve means 14, in accordance with the present invention, permits the lubrication assembly of the present invention to retain the peak lubricant pressure available in accordance with the operation of the lubrication assembly of the invention as will hereinafter be explained.

Details of the construction and structure of valve means 14 may, however, be found in my U.S. Pat. No. 4,094,293, the disclosure of which is expressly incorporated herein by reference.

Referring to FIG. 3, there is schematically illustrated a circuit comprising engine ignition switch 54, conventional battery 53, and coil 46 of solenoid actuated valve means 14. Coil 46 of solenoid actuated valve means 14 is in series with ignition switch 54. Thus, when ignition switch 54 is closed, solenoid actuated valve means 14 will be energized and plunger 47 will be forced into contact with diaphragm 42. When ignition switch 54 is opened, solenoid actuated valve means 14 will be de-energized and spring member 50 will urge plunger 47 out of contact with diaphragm 42.

In operation, ignition switch 54 is closed and the engine is thereby turned on. The engine lubrication pump slowly starts to build up lubricant pressure and to supply pressurized lubricant to the engine and to the center bearing of the turbocharger. Upon closing ignition switch 54, solenoid 32 of valve means 14 is energized and forces plunger 47 into contact with diaphragm 42 closing off apperture 44 and also forcing diaphragm 42 against partitions 38. With diaphragm 42 forced against partitions 38 and aperture 44 closed, chamber 40 and thus fluid conduit means 20 are closed off from fluid communication with reservoir means 11. Thus, lubricant flowing in fluid conduit means 25 cannot flow into reservoir means 11.

As the engine lubricant pump continues to operate, lubricant pressure continues to increase, and thus, the pressure of the lubricant flowing in fluid conduit means 25 continues to increase. When the pressure of the lubricant flowing in fluid conduit means 25 reaches a selected value, say 40 psig in the example previously discussed, the lubricant pressure in chamber 40 will be sufficient to lift diaphragm 42 off partitions 38 against the force of plunger 47 as provided by the energized solenoid 32. Lubricant will then flow over partitions 38 into chamber 41, through aperture 35, connection 23 and into the bellows means 13 of reservoir means 11. Substantially unrestricted fluid flow between fluid conduit means 25 and the reservoir means 11 has been established. The bellows means 13 will start to fill with the lubricant and expand within container 12 of reservoir means 11 thereby compressing the air within container 12 on the air side 16 of the bellows 13. Pressurized lubricant is thus being stored in the reservoir means 11.

Since the engine has just started, it is cold and the viscosity of the lubricant is at its greatest. Lubricant pressure will continue to build until it reaches a peak pressure which in the prior example may be 65–70 psig. The lubricant filling the reservoir means 11 will be stored at this peak pressure.

It will be appreciated that pressurized lubricant is also flowing through aperture 45 into chamber 43 above the diaphragm 42. When the engine heats up, the pressure of the lubricant flowing in fluid conduit means 25 and thus the pressure of the lubricant flowing through fluid conduit means 20 into chamber 40 will start to drop. When the lubricant pressure starts to drop, the pressure of the lubricant in chamber 43 above diaphragm 42 in combination with the force exerted by plunger 47 on diaphragm 42 cause diaphragm 42 to be reseated and urged against partition 38. Thus chamber 40 and thereby fluid conduit means 20, 25 have again been closed off from fluid communication with reservoir means 11. Lubricant at peak pressure has thus been stored in reservoir means 11 and it is prevented by the valve means 14 from being discharged to fluid conduit means 25 as the pressure of the lubricant flowing in fluid conduit means drops to normal operating pressure.

Subsequently, the engine will be shut down by opening ignition switch 54. With the engine shut down, the engine lubricant pump will stop supplying lubricant via fluid conduit means 25 to the center bearing of the turbocharger. When the ignition switch 54 opens shutting down the engine, solenoid 32 will be de-energized and thus spring member 50 will urge plunger member 47 off diaphragm 42. This opens aperture 44 and the pressurized lubricant in chamber 43 above diaphragm 42 will pass through aperture 44 into chamber 40. Since aperture 44 is larger than aperture 45, the lubricant pressure in chamber 43 will rapidly become less than the lubricant pressure in chamber 41. Thus, the lubricant in chamber 41 will force diaphragm 42 off partitions 38 and therefore establishes substantially unrestricted fluid flow from reservoir 11 through valve means 14, fluid conduit means 20, and fluid conduit means 25 in order to provide lubrication to the center bearing during spin down of the turbocharger after engine shut down.

It is apparent that alternative circuits could be provided to selectively energize and de-energize the solenoid actuator of valve means 14. For example, a pressure sensor switch could be mounted in fluid conduit means 25 which would close a circuit and energize solenoid 32 when a very low threshold pressure, say for example 5 psig, was sensed in fluid conduit means 25 before the check valve (pump side). Upon engine shutdown, when the pressure drop in the fluid conduit means 25 occurs because of the stopping of the lubrication pump, the pressure sensing means would open the circuit to solenoid 32. Accordingly, reservoir means 11 would start to supply lubricant to the center bearing. During initial engine start-up, the solenoid valve would not be energized until the pressure flowing in fluid conduit means 25 attained the very low pressure threshold say, e.g., 5 psig. However, during this short initial period of very low pressure, the flexible diaphragm 42 itself resting against partitions 38 would substantially prevent lubricant from flowing into reservoir means 11 because the very low pressure lubricant would not be very effective in lifting diaphragm 42 off partitions 38 of valve means 14. If further flow restriction into reservoir means 11 during this very low pressure period is desired, flow restrictors such as disclosed in my co-pending U.S. patent application Ser. No. 557,313 filed Dec. 2, 1983 and entitled Improved Pressurized Lubrication Assembly For Machinery Having A Flow Restricter Device may be employed.

The described pressure sensor means disposed in fluid conduit means 25 for energizing and de-energizing the solenoid 32 would have one further advantage. If there was a failure of the engine lubrication system, such as failure of the lubricant pump, and lubrication to the center bearing was lost, the reservoir means 11 would start providing lubricant to the center bearing as soon as lubricant pressure in fluid conduit means 25 dropped below the very low threshold pressure. Engine shutdown would not be required before the reservoir means started the supply of lubricant to the center bearing.

If desired, valve means 14 may be provided with relief valve means for reservoir lubricant over pressure conditions as disclosed in my co-pending U.S. patent application Ser. No. 557,397 which is a continuation-in-part of my U.S. patent application Ser. No. 331,371 filed Dec. 16, 1981.

It is contemplated that one skilled in the art may be able to practice the invention with valve designs other than the preferred valve means 14 disclosed herein in detail. It is contemplated that vacuum operated bi-directional valves could be used in addition to solenoid actuated bi-directional valves. Furthermore, plunger 47 of disclosed valve means could being operated by hand during appropriate periods of the described operating cycle rather than being actuated by a solenoid.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A pressurized lubrication assembly for a center bearing of an exhaust-driven turbocharger associated with an internal combustion engine wherein said engine includes means for providing flow of pressurized lubricant through first conduit means to said turbocharger when said engine is running, said lubrication assembly comprising:

reservoir means for storing a quantity of lubricant under pressure;

second conduit means coupled to said reservoir means and said first conduit means for permitting flow of lubricant between said reservoir means and said first conduit means;

valve means disposed in said second conduit means for controlling flow of lubricant between said first conduit means and said reservoir means wherein said valve means includes:

means for substantially restricting flow of lubricant from said first conduit means to said reservoir means when the pressure of lubricant flowing in said first conduit means is below a selected pressure;

means for permitting substantially unrestricted lubricant flow from said first conduit means to said reservoir means when the pressure of lubricant flowing in said first conduit means is at or exceeds a selected pressure;

means for preventing flow of lubricant from said reservoir means to said first conduit means when said engine is providing flow of pressurized lubricant to said turbocharger;

means responsive to shut down of said engine for providing substantially unrestricted flow of lubricant from said reservoir means to said first conduit means and thereby said turbocharger.

2. The assembly recited in claim 1 wherein said valve means includes solenoid actuated means.

3. The assembly recited in claim 1 wherein said unrestricted lubricant flow from said first conduit means to said reservoir means permitted by said valve means fills said reservoir means with lubricant and compresses air contained therein thereby providing a quantity of lubricant stored under pressure in said reservoir means.

4. The assembly recited in claim 1 wherein said valve means includes:

a valve body and a valve cover with a diaphragm positioned between said valve body and said valve cover;

said valve body being divided into first and second chambers by a partition, said diaphragm contacting said partition and further defining said first and second chambers and cooperating with said cover to define a third chamber, and further wherein said first and second chambers are in fluid communication with said first fluid conduit and said reservoir means respectively;

said diaphragm includes first and second orifices, said first orifice permitting fluid flow between said first and third chambers and said second orifice permitting fluid flow between said second and third chambers wherein said first orifice is an opening greater in area than said second orifice;

plunger means for selectively engaging said diaphragm and closing said first orifice, wherein said plunger means engages said diaphragm and closes said first orifice when said engine is providing flow of pressurized lubricant to said turbocharger; and said plunger means disengages said diaphragm and opens said first orifice when said engine is not providing said flow of pressurized lubricant to said turbocharger.

5. The assembly recited in claim 4 wherein said plunger means engages said diaphragm and closes said first orifice when said engine is turned on and wherein said plunger means disengages said diaphragm and opens said first orifice when said engine is shut down.

6. The assembly recited in claim 4 wherein said plunger is actuated by solenoid means.

7. The assembly recited in claim 5 further including:

means for energizing said solenoid means when said engine is providing flow of pressurized lubricant to said turbocharger wherein said energized solenoid causes said plunger means to engage said diaphragm and close said first orifice thereby substantially preventing flow of pressurized lubricant stored in said reservoir means from said reservoir means to said first conduit means;

means for de-energizing said solenoid means when said engine is not providing said flow of pressurized lubricant to said turbocharger; and means for causing said plunger means to disengage said diaphragm and open said first orifice when said solenoid means is de-energized thereby permitting substantially unrestricted flow of pressurized lubricant from said reservoir means to said first conduit means and thereby to said turbocharger.

8. The assembly recited in claim 6 wherein said solenoid means is energized when said engine is turned on and wherein said solenoid means is de-energized when said engine is shut down.

9. The assembly recited in claim 6 wherein said means for causing said plunger means to disengage said diaphragm and open said first orifice when said solenoid means is de-energized comprises resilient means.

10. The assembly recited in claim 2 wherein said solenoid means is energized when said engine is providing flow of pressurized lubricant to turbocharger and wherein said energized solenoid causes said valve means to substantially prevent flow of lubricant from said reservoir means to said first conduit means.

11. The assembly recited in claim 9 wherein said solenoid means is energized when said engine is turned on.

12. The assembly as recited in claim 2 further including means for de-energizing said solenoid means when said engine is not providing said flow of pressurized lubricant to said turbocharger wherein said de-energized solenoid means in cooperation with resilient means causes said valve means to provide substantially unrestricted flow of lubricant from said reservoir means to said first conduit means and thereby to said turbocharger.

13. The assembly recited in claim 11 wherein said solenoid means is de-energized when said engine is shut down.

14. The assembly recited in claim 1 wherein said reservoir means is so dimensioned so as to have a capacity for storing a volume of said lubricant which is greater than that required by said center bearing during turbocharger spin down when said engine is shut down.

15. A pressurized lubrication assembly for a center bearing of an exhaust-driven turbocharger associated with an internal combustion engine wherein said engine includes means for providing flow of pressurized lubricant through conduit means to said turbocharger when said engine is running, said lubrication assembly comprising:

reservoir means for storing a quantity of lubricant under pressure;

means responsive to the shut down of said engine for providing flow of lubricant from said reservoir means to said turbocharger center bearing.

* * * * *